US005836085A

United States Patent [19]

Ben-Ezra

[11] Patent Number: 5,836,085

[45] Date of Patent: Nov. 17, 1998

[54] PAINT-SPRAYING AND CURING BOOTH WITH FIRED RADIANT HEATERS

[76] Inventor: Joshua S. Ben-Ezra, Box 185A Fawn Hill Rd., Tuxedo Park, N.Y. 10987

[21] Appl. No.: 891,338

[22] Filed: Jul. 10, 1997

[51] Int. Cl.[6] ..... F26B 3/34

[52] U.S. Cl. ..... 34/270; 34/277; 34/666; 165/134.1

[58] Field of Search ..... 34/267, 270–277, 34/271, 272, 666; 165/134.1

[56] References Cited

U.S. PATENT DOCUMENTS

| | | | |
|---|---|---|---|
| 2,688,685 | 9/1954 | Goodell | 219/35 |
| 4,125,366 | 11/1978 | Boyer | 432/209 |
| 4,136,463 | 1/1979 | Nolan et al. | 34/272 |
| 4,546,553 | 10/1985 | Best | 34/266 |
| 5,158,486 | 10/1992 | Tamame | 62/506 |
| 5,230,161 | 7/1993 | Best | 34/267 |
| 5,398,425 | 3/1995 | Cherry et al. | 34/270 |
| 5,594,999 | 1/1997 | Best | 34/270 |

*Primary Examiner*—William Doerrler
*Attorney, Agent, or Firm*—Thomas H. Whaley

[57] ABSTRACT

An improved paint spraying-paint curing booth for automobiles and the like is disclosed in which direct fired U-tube radiant heaters supply radiant heat to the freshly painted article effecting rapid heating and curing of the paint. The radiant heating system may be built into the booths during manufacture or retrofitted to existing spray booths. Substantial savings in both time and energy result from use of the disclosed system.

4 Claims, 2 Drawing Sheets

PAINT-SPRAYING AND CURING BOOTH WITH FIRED RADIANT HEATERS

This invention relates to a housing or booth in which an automobile or other large object may be paint sprayed and the paint heat cured safely and efficiently. In one of its more specific aspects, the invention relates to a spraying and drying booth for large objects, for example, automobiles and small trucks.

Enclosures for spraying and heat curing paint on automobile bodies are in widespread use by small automobile body repair shops for repainting automobiles after repair or to restore finish after an extended period of use. Such paint spray booths are commonly prefabricated metal buildings which follow a more or less conventional design. A conventional design consists of a steel frame, sheet metal building large enough to hold a motor vehicle with sufficient room on all sides of the vehicle for workmen to effectively operate paint spray equipment. Air filters in a wall of the building through which clean air is drawn into its interior by means of an exhaust fan prevent dust from marring freshly painted surfaces. The exhaust fan serves to remove paint solvent vapors from the booth and to insure a safe environment for workers in the booth.

In a conventional paint spray booth, after spray painting is completed, the paint is heat cured by blowing externally heated air into the booth. Typically, the paint curing time in the conventional paint spray booth is one hour.

The present invention provides an improvement in paint spraying and heat curing booths of the type described which results in much shorter paint curing times and a savings in fuel costs. These advantages are accomplished by providing a safe and efficient method for supplying radiant heat from gas fired heaters directly to the freshly painted object, e.g. automobile, during the heat curing period.

Infrared radiant heat for drying and curing paint has been used heretofore to cure and dry coatings. As described in U.S. Pat. No. 4,546,553, the walls of the drying chamber are heated to serve as a radiant heat source. Electrical heaters appear to be more practical, as described in U.S. Pat. No. 4,621,187. As pointed out in this patent, because of the high inflammability of the volatile organic solvents used in spray paints, it has not been permissible for safety reasons to permanently install heaters in paint spray booths. U.S. Pat. No. 4,621,187 solves the safety problem by providing an interlock mechanism with time delays to prevent activation of the heaters and paint sprayers simultaneously.

There is still a need for a simple and durable paint spraying and drying booth which is both safe and more economical to build and operate than existing booths.

A principal object of this invention is to provide a combined paint spraying and paint curing booth which is safe to use and which has a low operating cost.

Another important object is to provide a paint spraying and paint curing booth with gas-fired radiant heaters that extend over substantially the full length of an automobile or other similar elongated product.

These and other features and advantages of the invention will be apparent from the description which follows.

SUMMARY OF THE INVENTION

In accordance with this invention, a simple enclosure for drying freshly painted automobiles and similar large products is equipped with a single, gas or oil-fired infrared heater in each of the two long walls of the enclosure. Each heater is in the form of a U-shape steel tube of about three inches in diameter. In a preferred embodiment, fuel gas, natural gas or propane is admixed with sufficient air to ensure complete combustion of the fuel, injected and fired at the end of one leg of each U-tube and the combustion product gases discharge from the end of the other leg of the U-tube. Such radiant U-tube gas heaters are marketed under the trademark RAY-TEC by Sun Technology Corporation of Shelby Townships, Mich. 48315. U-tube heaters of 20 to 30 feet in length with rated heat inputs of 85,000 to 150,000 Btu's per hour are available and suitable for use with the paint-spraying-curing booths of this invention. In contrast to paint-curing enclosures of the prior art each of which require many heating units, the novel enclosure requires only a pair of gas fired radiant U-tube heaters that are economically attractive in first cost, installation, maintenance and operation.

BRIEF DESCRIPTION OF THE DRAWINGS

To facilitate further description and understanding of the invention, reference will be made to the accompanying drawings of which:

FIG. 2*a* is a fragmentary cross-sectional view of the heater shown in FIG. 2.

DESCRIPTION OF A PREFERRED EMBODIMENT

Figure 1:
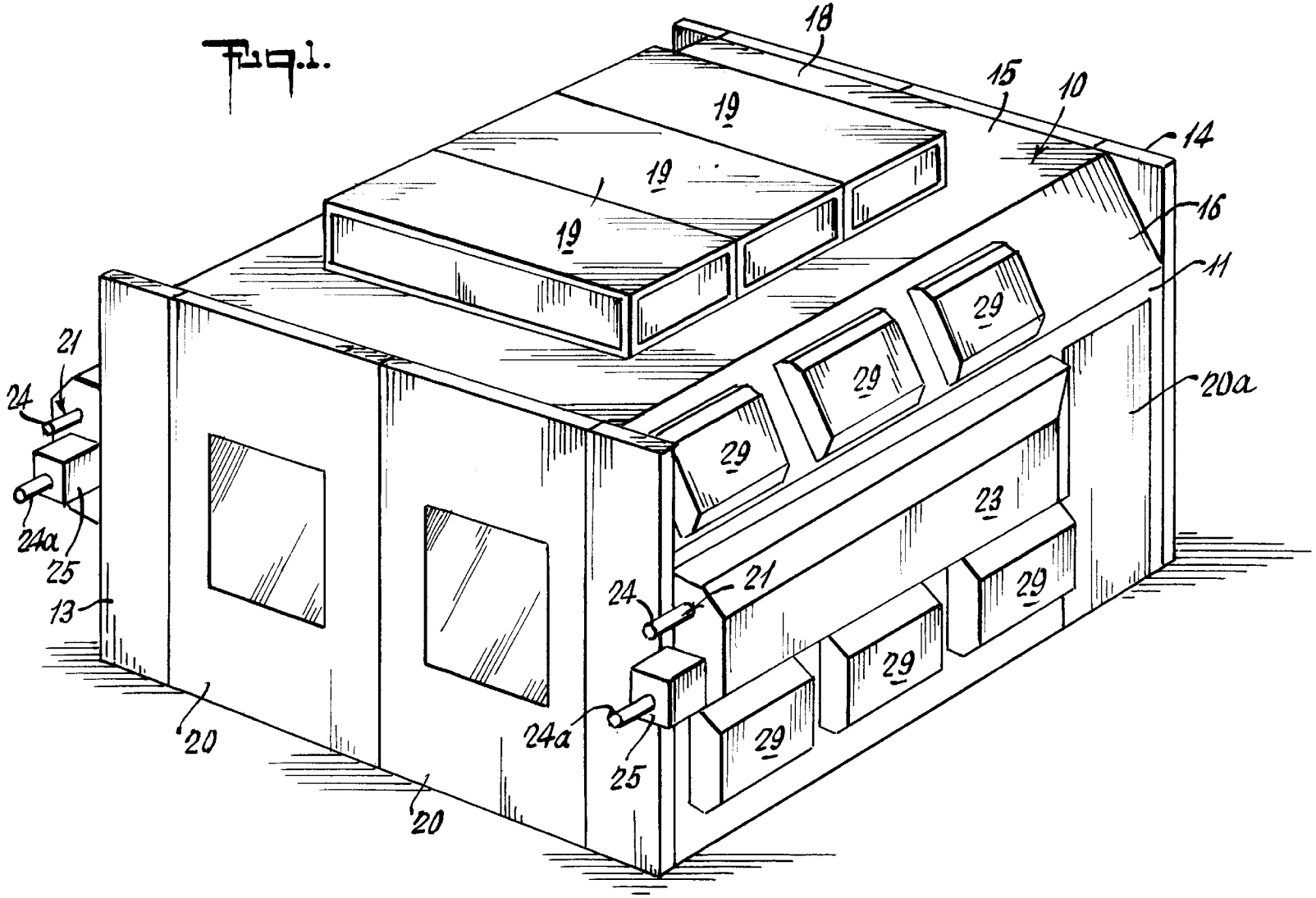
FIG. 1 illustrates in perspective a paint-spraying and paint-curing booth having a pair of gas-fired U-tube radiant heaters.

A conventional paint spraying and curing booth is illustrated in the figures with modifications in the paint curing system according to this invention.

As illustrated, the numeral 10 designates a rectangular housing or booth with a pair of opposite side walls 11, 12, end walls 13, 14, and roof formed by two oppositely sloped panels 16, 17, and connecting horizontal panel 18. Roof panel 18 have compartments 19 mounted thereon which contain equipment (not illustrated) for supplying heat and filtered fresh air to the booth 10 and for exhausting air and volatile organic solvent vapors from the booth during spray painting operations. Paint and solvent vapors in the exhaust air may be chemically or physically removed or destroyed before discharging it to the atmosphere.

End wall 13 of booth 10 has a large opening with a pair of doors 20 through which an automobile can enter or exit the booth and a pedestrian door 20*a* (FIG. 1) to permit ready access by workmen. Booth 10 and its associated equipment housed in compartments 19 on the top of the building are, per se, conventional components of prefabricated spray booths available commercially from a number of manufacturers. Conventionally, hot air is supplied to the interior of the booth from an external heater (not illustrated) housed in compartment 19 during the paint drying and curing period.

Figure 2:
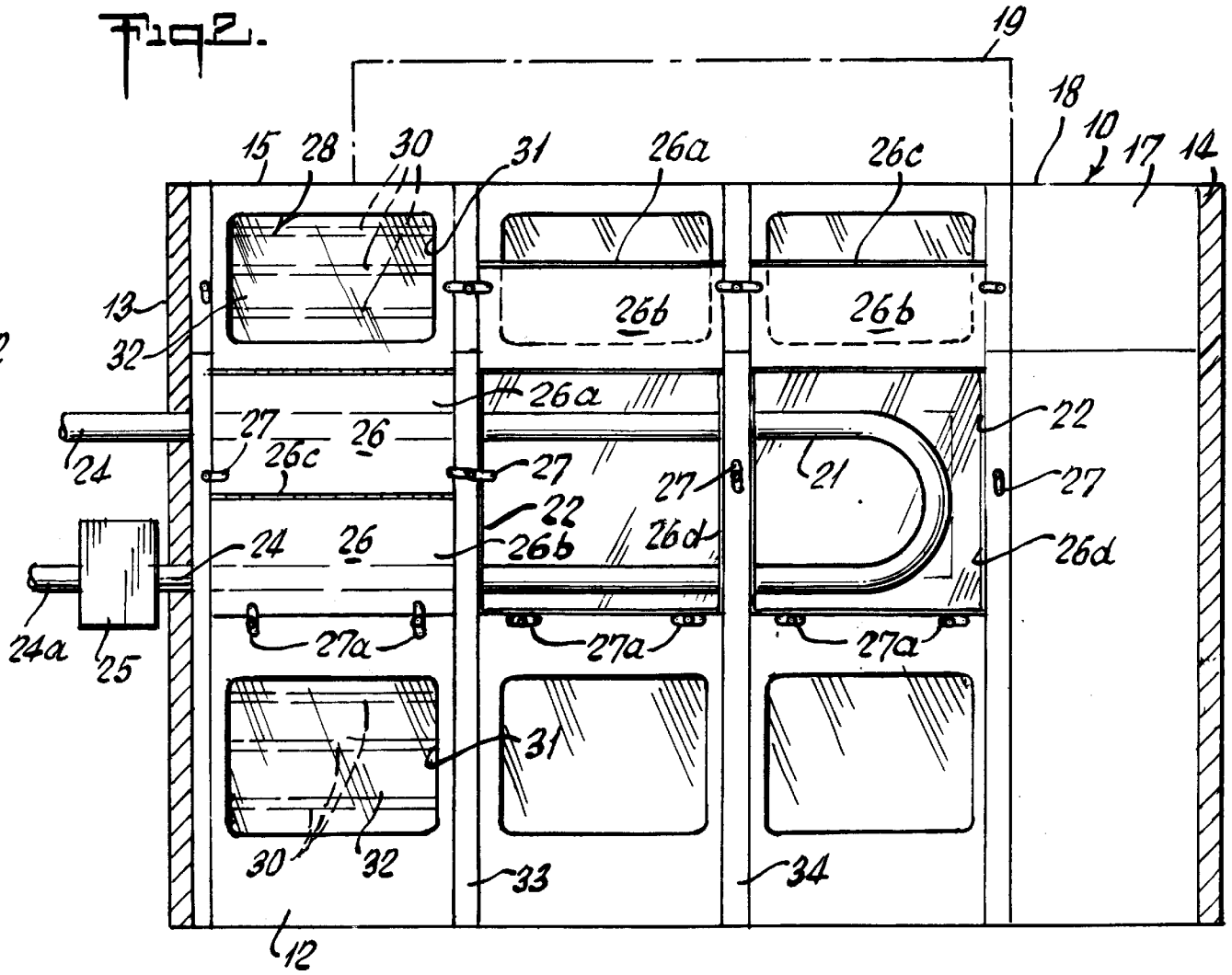
FIG. 2 is an inside elevational view of one wall of the booth of FIG. 1 with a U-tube radiant heater.
Figure 3:
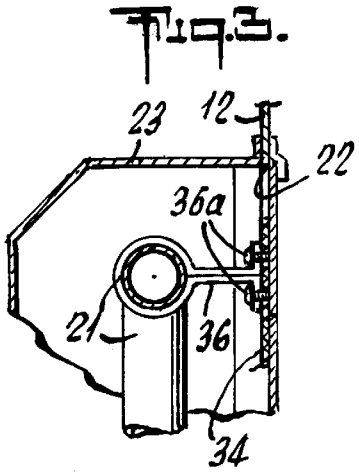

In accordance with my invention, booth 10 becomes a distinctly novel and effective paint-spraying/paint curing system by the addition of a gas-fired U-tube radiant heater 21 horizontally along each of side walls 11, 12. Horizontal apertures 22 in each of walls 11, 12 extend over the full length and width of radiant U-tube heater 21 as illustrated in FIG. 2. Radiant heaters 21 are positioned outside the spray booth area near the outer face of each of walls 11, 12. Thus, apertures 22 provide an unobstructed window through which infrared radiation from gas-fired U-tube heater 21 may pass directly to a freshly painted automobile or other product.

Heater housings 23 attached to each of walls 11, 12 form a recessed container for the U-tube heater 21 mounted along that wall. Heater housings 23 not only seal apertures 22 in walls 11, 12 so that air cannot flow through apertures 22 but also act as reflectors of the radiation emitted by the portions of U-tubes 21 not facing apertures 22. The interior surface of housings 23 exposed to infrared radiation preferably should have good heat reflectivity. For use in the structure of this invention, galvanized steel is satisfactory as a heat reflective housing without the need for optional polished aluminum reflectors.

The ends of both branches or legs 24 of each U-tube 21 protrude through an end of its reflective heater housing 23. One leg end 24 is connected to a control box 25 which contains the gas valve, igniter, burner, and other combustion controls (not illustrated), while the other leg end 24 is connected to a stack (not shown) to vent the combustion product gases discharged from U-tube 21. Fresh air inlet 24*a* to control box 25 is connected to an inlet pipe (not shown) for supplying solvent free air to the control box 25 to avoid danger of ignition of solvent vapors.

Paint-drying booth 10 in most cases provides a desirable enclosure for spraying paint on an automobile or other product. To prevent paint and solvent vapors from accumulating in heater housings 23, hinged metal shield panels 26 are provided to cover and seal apertures 22 during paint spraying operations. As shown in FIG. 2, shield 26 is hinged along its top edge to wall 12. Preferably, shield 26 comprises two sections, panels 26*a* and 26*b* joined by hinges 26*c*. The shield can be swung down as illustrated when booth 10 is to be used for spraying paint and folded up as illustrated when the heaters 21 are to be used for curing the paint on the vehicle surface. Clamps or retainers 27 serve to hold shield 26 in place over aperture 22 during a paint spraying operation. Seals 26*d* are provided around the outer edges of shield 26 to ensure vapor tight barrier when panels 26*a* and 26*b* are locked in closed position by retainers 27*a*.

The inner edges of panels 26*a* and 26*b* are provided with heat resistant synthetic rubber sealing strips 32 which form a vapor tight barrier between the interior of booth 10 and the heater housing 23 when the panels are in closed position. Panels 26*a* and 26*b* are held firmly by latches 27*a* when in closed position and by latches 27*b* when in open position, both as illustrated in FIG. 2.

Through adjustment means in control box 25 connected to each of the two U-tube heaters 21 the desired temperature appropriate for the particular paint that is to be cured can be attained and maintained until the paint is completely dried and cured.

Particularly to facilitate paint spraying in booth 10, lights 28 are set in walls 11, 12. While lights 28 may be in various forms, FIG. 2 shows each in the form of a shallow reflector pan 29 attached to the exterior side of wall 11 and containing fluorescent light tubes 30. An aperture 31 in wall 11 to permit light from fluorescent tubes 30 to shine into booth 10 is preferably sealed by a glass pane 32 which can periodically be cleaned of any paint must be deposited thereon. Similar reflector pans 29 with fluorescent light tubes 30 are attached to each of panels 16, 17, and wall 12.

As illustrated in FIG. 2, the booth may be is constructed of sheet steel over a framework of channel iron ribs 33 and 34. Ribs 33 typically are formed of 4×4 inch channel iron and ribs 34 of 2×4 inch channel iron. The U-tubes 21 are supported in place in their housings 23 by support brackets 36 held in by attachment to ribs 34, suitably by means of self-tapping screws 36.

As a specific example of a spray booth with radiant heaters as contemplated by this inventions U-tube radiant heaters are installed along the side walls of a typical spray booth. In this example, each of the U-tube heaters is 21 feet in overall length by three inches in diameter each with a heat input of 85,000 Btu per hour. The U-tube heating units are positioned as illustrated in FIG. 2, near the top of vertical side walls 11 and 12. In this specific example, the legs of the U-tubes are spaced about 12 inches apart center to center and enclosed by a galvanized sheet metal housing 23 spaced about 4 inches away from the surface of tube 21 at the nearest point. Overall dimensions of the housing 23 are about 22 feet in length by 27 inches high by nine and one half inches deep. Outside air is supplied to the burner control boxes 25 through 4 inch diameter air ducts (not illustrated) and exhaust gases from the heaters discharged from the heaters to the atmosphere through similar exhaust ducts (not illustrated). At rated heat input of 170 thousand Btu per hour for the two heaters, paint on a freshly painted automobile body is dried and heat cured in 15 minutes. At the end of the curing time, the metal body temperature reaches 180° F.

Prior to installation of the radiant heaters of this invention, drying and curing with hot air supplied to the same booth from external air heaters rated at 1 million Btu's per hour required 1 hour curing time at 160° to 180° F. It is evident that the paint spraying and paint drying booth constructed in accordance with this invention effects substantial savings in operation, both in time and in fuel costs.

Although gas, e.g. natural gas or a liquified petroleum gas, such as propane, is a preferred fuel supplied to the above-described heaters, other hydrocarbon fuels, including petroleum distillates, e.g. gasoline, kerosene, or fuel oil, may be used if desired.

It will be understood by those skilled in the art that paint spray booths of the type described are designed to isolate the automobile or other article being painted from the surrounding work area. Usually the paint spray booth is entirely enclosed in a surrounding building, for example, in a automobile repair shop. To avoid air pollution and health hazards, the air exhausted from the paint spray booths is discharged to the atmosphere outside the building enclosing the spray booth. Similarly, the exhaust gases from the gas-fired radiant heaters forming a part of this invention are vented through suitable duct work, not illustrated in the accompanying drawings. Preferably air supplied to the gas-fired burners of the radiant U-tube heaters is drawn in from outside the enclosed work area by suitable duct work not illustrated.

I claim:

1. In a paint spraying and paint curing booth comprising a closed ventilated chamber adapted for containment of a vehicle or other article to be painted and provided with an externally mounted radiant heater in an externally closed reflective housing open to said chamber, the improvement comprising at least one panel adapted to form a vapor tight seal between said housing and said chamber in closed position during paint spraying operations, and means for maintaining said panel in open position to provide unobstructed flow of radiant energy from said heat source to said chamber during paint curing operations.

2. A paint spraying and paint curing chamber according to claim 1 wherein the panels are hinged at their upper edges to permit opening of the panels when the radiant heaters are activated during paint curing operations and closing of the panels when the heaters are not in use.

3. A paint spraying and paint curing booth according to claim 1 wherein the radiant heaters comprise metal tubes internally heated by combustion gases from a gas-fired burner.

4. A paint spraying and paint curing booth according to claim 1 wherein the heaters are in the form of U-tubes providing uniform heat distribution along their lengths.

* * * * *